US006605009B1

(12) United States Patent
Nakamura et al.

(10) Patent No.: US 6,605,009 B1
(45) Date of Patent: Aug. 12, 2003

(54) SOLID GOLF BALL

(75) Inventors: Atsushi Nakamura, Chichibu (JP); Hisashi Yamagishi, Chichibu (JP); Takashi Maruko, Chichibu (JP); Yutaka Masutani, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/484,056

(22) Filed: Jan. 18, 2000

(30) Foreign Application Priority Data

Feb. 10, 1999 (JP) ..... 11-032602

(51) Int. Cl.[7] ..... A63B 37/02
(52) U.S. Cl. ..... 473/374
(58) Field of Search ..... 473/373, 374, 473/377, 376, 370, 367, 368

(56) References Cited

U.S. PATENT DOCUMENTS 5,072,944 A 12/1991 Nakahara ..... 273/220
5,772,531 A * 6/1998 Ohsumi et al. ..... 473/376
5,780,169 A * 7/1998 Hiraoka et al. ..... 428/517
5,783,293 A * 7/1998 Lammi ..... 473/373
5,967,907 A * 10/1999 Takemura et al. ..... 473/373
6,071,201 A * 6/2000 Maruko ..... 473/373
6,213,895 B1 * 4/2001 Sullivan et al. ..... 473/374
6,248,029 B1 * 6/2001 Maruko ..... 473/374

FOREIGN PATENT DOCUMENTS

JP 3-009769 1/1991 ..... A63B/37/00
JP 6-170012 * 6/1994

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

In a solid golf ball comprising a solid core and a cover, the solid core has a multilayer construction which includes a center core and an outer core of at least one layer that encloses the center core. The center core is formed primarily of a resin and has a diameter from 3 mm to less than 15 mm. The outer core is formed of a rubber composition based on polybutadiene. The center core has a surface hardness which is higher than the hardness of an innermost layer of the outer core. The ball has a high-pitched click and a soft feel.

17 Claims, 1 Drawing Sheet

SOLID GOLF BALL

The present invention relates to a solid golf ball having a soft "feel" and high-pitched "click" when hit with a golf club.

BACKGROUND OF THE INVENTION

The current mainstream is soft type golf balls. Attempts to make the core and cover soft are successful in giving the ball a soft feel when hit with a club. As the ball itself becomes soft, the clicking sound made when the ball is hit becomes so dull and weak that golfers cannot make sure that their strike conveys the ball far. This problem is contradictorily solved by making the core or cover hard.

This is also true for golf balls of the multilayer construction which now become predominant. Under the trend toward softening, major efforts are made on golf balls to improve the flight and spin performance thereof, with little attention being paid to the click.

SUMMARY OF THE INVENTION

An object of the invention is to provide an improved solid golf ball having a soft feel and an agreeable click.

The invention provides a solid golf ball comprising a solid core and a cover that encloses the solid core, the solid core having a multilayer construction which includes a center core and an outer core of at least one layer that encloses the center core. The center core is formed primarily of a resin and has a diameter from 3 mm to less than 15 mm. At least one layer of the outer core is formed of a rubber composition based on polybutadiene. The center core has a Shore D hardness at its surface which is higher than the Shore D hardness of an innermost layer of the outer core.

Preferably, the center core has a specific gravity of 1.0 to 1.5 which is greater than the specific gravity of the at least one layer of the outer core formed of a rubber composition based on polybutadiene. The center core typically has a natural frequency of at least 1,000 Hz. Also preferably, the solid core has a rebound of at least 90 cm when dropped under gravity from a height of 120 cm.

In an effort to improve the dull click of a soft solid core ball, the inventor investigated the use of hard material in the center core. When a rubber composition as used in forming the center core of conventional solid cores was used as the hard material and molded and vulcanized under such conditions as to achieve a high hardness, there arose several problems including a limit on the achievable hardness and a low productivity resulting from kneading, extruding and grinding steps. It was then attempted to form the center core from a resin base material. Since the use of resinous materials which are less resilient than rubber naturally compromises resilience, it is generally believed undesirable to use a less resilient material in the center core. Even when a resinous material is used in the center core, an improvement in click can be made by suitable steps. That is, by forming the center core to a small diameter of 3 mm to less than 15 mm and using a polybutadiene-base rubber composition in the outer core around the center core, the ball can be given a clicking sound without detracting from the resilience of the solid core. By optimizing the hardness, specific gravity and other physical properties of the respective layers, the clicking sound of the solid golf ball is further improved while maintaining the performance and feel inherent to soft solid cores.

BRIEF DESCRIPTION OF THE DRAWING

The only FIGURE.

DETAILED DESCRIPTION OF THE INVENTION

Figure 1:
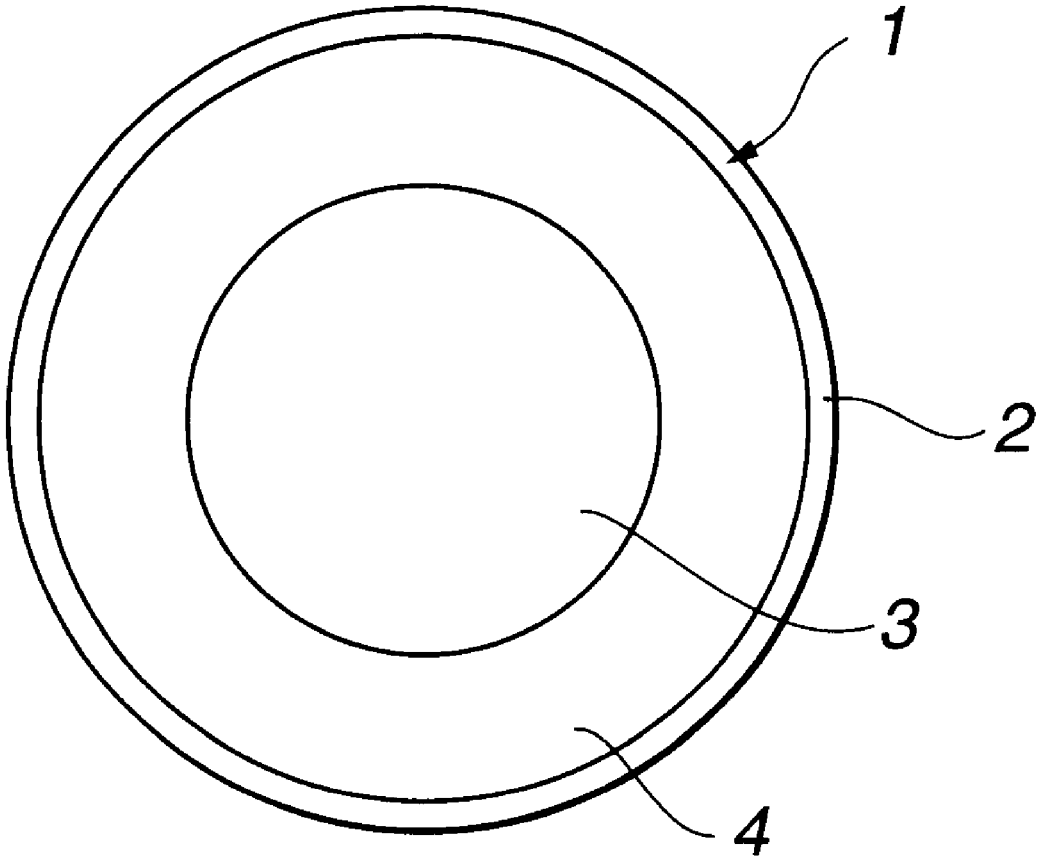
FIG. 1 is a sectional view showing a solid golf ball according to one embodiment of the invention.

Referring to FIG. 1, the solid golf ball of the invention has a solid core 1 enclosed within a cover 2. The solid core 1 has a center core 3 and an outer core 4 which covers the surface of the center core 3 and is itself enclosed by the cover 2. The solid core 1 shown in FIG. 1 is composed of two layers and the cover 2 is composed of a single layer. However, if necessary, the outer core 4 of the solid core 1 may itself be composed of two or more layers, and the cover 2 may be composed of two, three or more layers.

Unlike prior-art golf balls, the center core 3 in the solid core 1 of the inventive golf ball is not made of a rubber composition, but rather is composed primarily of a resin.

Examples of resins that may be used in the center core 3 include known thermoplastic resins and thermoplastic elastomers, such as nylons, polyarylates, ionomer resins, polypropylene resins, thermoplastic polyurethane elastomers and thermoplastic polyester elastomers. Commercially available resins that are highly suitable for this purpose include Surlyn AD8512 (an ionomer resin manufactured by E. I. DuPont de Nemours and Co.), Himilan 1706 and 1707 (ionomer resins manufactured by DuPont-Mitsui Polychemicals Co., Ltd.), Rilsan BMNO (a nylon resin manufactured by Toray Industries, Inc.) and U-Polymer U-8000 (a polyarylate resin manufactured by Unitika, Ltd.).

If desired, an inorganic filler such as barium sulfate, titanium dioxide or zinc oxide may be included as a weight modifier in the resin material. The weight of the center core 3 can be increased by incorporating a large amount of such a filler. This in turn allows the proportion of the rubber component in the outer core 4 (subsequently described) to be increased, enabling a remarkable improvement in the resilience of the golf ball. The use of a high specific gravity filler is advantageous in production as well in that it allows the degree of center core eccentricity to be easily determined nondestructively by x-ray inspection. The amount of weight modifier included is preferably 0 to about 115 parts by weight, and especially about 5 to about 100 parts by weight per 100 parts by weight of resin.

The center core made primarily of the above type of resin has a diameter of from 3 mm to less than 15 mm, preferably 5 to 12 mm, and especially 6 to 10 mm. Too small a center core fails to achieve the intended effects, whereas one that is too large may adversely affect the resilience of the ball.

Preferably the center core has a specific gravity of from 1.0 to 1.5, and especially 1.1 to 1.4. Also preferably, so the center core has a natural frequency of at least 1,000 Hz, more preferably at least 1,500 Hz, and most preferably at least 2,000 Hz. A center core with a lower natural frequency may be less effective for improving the click. Further preferably, the center core at the surface thereof has a Shore D hardness within a range of 40 to 95, and especially 50 to 95.

The center core can be produced by injection molding a center core material composed primarily of the above-described resin.

Next, the outer core 4 which encloses the center core 3 may be composed of a single layer or have a multilayer construction composed of two or more layers. At least one layer of the outer core is formed of a polybutadiene base rubber composition.

The rubber composition for use in the outer core is one essentially comprising polybutadiene as the base. The use of cis-1,4-polybutadiene having a cis structure of at least 40% is especially suitable. Where desired, other suitable rubber ingredients such as natural rubber, polyisoprene rubber or styrene-butadiene rubber may be compounded with the polybutadiene to give the base rubber. The resilience of the golf ball can be improved by increasing the proportion of the polybutadiene component. Up to about 10 parts by weight of the other rubber ingredients may be compounded per 100 parts by weight of the polybutadiene.

A crosslinking agent may be included in the rubber composition. Exemplary crosslinking agents are the zinc and magnesium salts of unsaturated fatty acids, such as zinc dimethacrylate and zinc diacrylate, and ester compounds such as trimethylpropane methacrylate. Zinc diacrylate is especially preferred for achieving a high resilience. The crosslinking,agent is preferably included in an amount of about 10 to 40 parts by weight per 100 parts by weight of the base rubber.

In the practice of the invention, a vulcanizing agent is generally compounded in the rubber composition. It is recommended that the vulcanizing agent include a peroxide having a one minute half-life temperature of lower than 155° C. in an amount of at least 30% by weight, and especially 40 to 70% by weight based on the overall vulcanizing agent. Examples of suitable peroxides include commercially available products such as Perhexa 3M (manufactured by Nippon Oils and Fats Co., Ltd.). The amount of vulcanizing agent included in the rubber composition is preferably from about 0.6 to 2 parts by weight per 100 parts by weight of the base rubber.

If necessary, other suitable ingredients may also be blended in the rubber composition, such as an antioxidants and specific gravity-modifying fillers (e.g., zinc oxide, barium sulfate). The amount of such specific gravity modifiers blended is typically from about 1 to 30 parts by weight per 100 parts by weight of the base rubber.

The outer core must have a layer made of the above-described rubber composition. When the outer core is composed of two or more layers, the other layer or layers may be made of similar rubber compositions or resin base compositions, and preferably similar rubber compositions. In any case, the layer of the rubber composition should preferably have a thickness of 2 to 19.5 mm, and especially 4 to 15 mm. Too thin a rubber composition layer may compromise the soft feel.

The rubber composition layer may have a specific gravity of 1.0 to 1.3, and especially 1.05 to 1.25. It is preferred that the specific gravity of the center core be greater than the specific gravity of the rubber composition layer because the ball is otherwise less resilient.

The invention further requires that the hardness of an innermost layer of the outer core be lower than the surface hardness of the center core. The objects of the invention including a good feel and click cannot be achieved if the surface hardness of the center core is lower than the hardness of the innermost layer of the outer core. The surface hardness of the center core is preferably 4 to 50 Shore D hardness units, and especially 6 to 40 units, greater than the hardness of the innermost layer of the outer core, especially in close proximity to the center core.

The solid core 1 composed of a center core 3 enclosed within an outer core 4 as described above preferably has a diameter of 36 to 41.5 mm and especially 37.5 to 39.5 mm. In order that the ball as a whole be fully resilient, the solid core preferably has a rebound of at least 90 cm, more preferably at least 95 cm, and most preferably at least 98 cm, when dropped under gravity from a height of 120 cm. The rebound is determined as a rebound height when a solid core as conditioned at 23° C. is vertically dropped under gravity from a height of 120 cm onto an iron disk having a diameter of 10 cm and a thickness of 10 cm.

Production of the solid core may be carried out using a known method to vulcanize and cure the rubber composition. For example, one highly suitable method is a two-step process in which the rubber composition is first subjected to primary vulcanization (semi-vulcanization) in a mold to form a pair of hemispherical cups. A preformed center core is then placed in one of the hemispherical cups, the other cup is closed over the center core, and secondary vulcanization (complete vulcanization) is carried out. That is, formation of the outer core also completes production of the solid core. Since the above method requires vulcanization to form the outer core, the center core is exposed to an elevated temperature. Hence, it is advantageous for the center core to have a melting point of at least 150° C.

An adhesive is typically applied to the center core before it is placed in the hemispherical cup. The adhesive provides a secure bond at the interface between the center core and the outer core, thereby enhancing the durability of the golf ball and helping to achieve a high resilience. To increase adhesion between the center core and the outer core, it is also advisable to roughen the surface of the center core in an apparatus such as a tumbler so as to form minute irregularities thereon before placing it in the outer core.

The golf ball of the invention is made by forming a cover 2 around the solid core 1. The cover may be made of a known cover stock material. Preferably the cover has a thickness of 0.5 to 3.5 mm, and especially 1 to 2.5 mm, and a Shore D hardness of 40 to 75, more preferably 45 to 70, and most preferably 50 to 65. A hardness that is too low may result in a poor ball resilience, whereas excessive hardness may compromise the durability of the ball. It is recommended that the cover have a specific gravity of 0.95 to 1.25. As already noted, the cover may be composed of one layer or a plurality of layers.

A known cover stock material may be used to form the cover. Examples include ionomer resins, balata rubber, and thermoplastic polyurethane, polyamide and polyester elastomers. The cover is preferably formed by a conventional injection molding process.

It is recommended that the solid golf ball thus formed have a deflection of 2.4 to 3.8 mm, and especially 2.6 to 3.5 mm under a static load of 100 kg.

As in conventional golf balls, the golf ball of the invention has numerous dimples formed on the surface of the cover. The total number of dimples is preferably from 350 to 500, more preferably from 370 to 480, and most preferably from 390 to 450. The dimples may be distributed in a geometrical arrangement that is octahedral or icosahedral, for example. Nor is the dimple pattern limited to a circular pattern, the use of any other suitable pattern, such as a square, hexagonal, pentagonal or triangular pattern, also being acceptable.

It is recommended to optimize the diameter, depth, and cross-sectional shape of dimples for improving the distance of the ball. Dimples may be provided so that the dimple surface coverage, which is defined as the ratio: (surface area of ball occupied by dimples)/(total surface area of ball) and expressed as a percentage, is preferably at least 65%, and more preferably 70% to 80%. A dimple surface coverage of less than 65% will sometimes fail to achieve an increased carry. The dimple volume ratio, which is defined as (total volume of dimples)/(volume of ball) and expressed as a percentage, may be set within a range of preferably 0.76% to 1.0%, and especially 0.78% to 0.94%. A dimple volume ratio less than 0.76% may result in too high a trajectory and a dimple volume ratio greater than 1.0% may result in too low a trajectory, the effect of either being a decrease in the carry of the ball.

The golf ball of the invention should be formed so as to have a diameter and weight which conform with the Rules of Golf. That is, the ball should have a diameter of not less than 42.67 mm and a weight of not greater than 45.93 g.

The solid golf ball of the invention, as described herein, provides a high-pitched click and a soft feel when hit with a golf club.

EXAMPLE

Examples of the invention and comparative examples are given below by way of illustration, and are not intended to limit the invention.

Examples 1–5 and Comparative Examples 1–3

In each example, a center core having the characteristics indicated in Table 1 was produced by injection molding a resin compound having the composition shown in the table in a mold. In addition, a rubber composition was intimately mixed in a roll mill, then subjected to 6 minutes of primary vulcanization (semi-vulcanization) at 130° C. to form a pair of hemispherical cups. The pair of cups was closed directly over the center core, following which the outer core was subjected to 15 minutes of secondary vulcanization (complete vulcanization) at 155° C. to give a solid core having a two-layer construction.

The cover stock material shown in Table 1 was then injection molded over the solid core in each example to form a cover having a thickness of 1.85 to 2.5 mm and bearing 392 dimples (dimple surface coverage, 78%; dimple volume ratio, 0.88%) to give a solid golf ball having the characteristics shown in the table.

The properties of the resulting golf balls were measured and evaluated as described below. The results are presented in Table 1.

Natural Frequency

While CF-920 (by Ono Sokki K. K.) generated random waves at 0 to 5 kHz, a shaker MS-VE-01N (by IMV) equipped with an impedance head IH-02 (by IMV) was attached to the core material to apply vibrations. Output signals were FFT processed by DS-9110 (by Ono Sokki K. K.) to determine a frequency response function, from which the natural frequency was calculated.

Flight Performance

The golf balls obtained in each example were measured for carry and total distance when hit with a driver (No. 1 wood) at a head speed of 45 m/s (HS45) using a swing robot.

Click and Feel

The click and feel of the golf balls in each example when hit with a No. 1 wood were rated as follows by three professional golfers.

Feel

Good: All three golfers thought ball had a soft feel.

Poor: All three golfers thought ball had a hard feel.

Click

Good: All three golfers thought click was high-pitched.

Fair: Two of the golfers thought click sounded hard and dull.

Poor: All three golfers thought click sounded hard and dull.

TABLE 1

| Composition (parts by weight) | | E1 | E2 | E3 | E4 | E5 | CE1 | CE2 | CE3 |
|---|---|---|---|---|---|---|---|---|---|
| Center core | Surlyn AD-8512 (ionomer) | 100 | — | — | — | — | 100 | — | — |
| | Rilsan BMNO (polyamide) | — | 100 | 100 | 100 | — | — | 100 | — |
| | Hytrel 4767 (polyester) | — | — | — | — | 100 | — | — | 100 |
| | Barium sulfate | 30 | 10 | 10 | 10 | — | 30 | 10 | — |
| Outer core | cis-1,4-Polybutadiene | 100 | 100 | 100 | 100 | 100 | 100 | — | 100 |
| | Zinc oxide | 5 | 5 | 5 | 5 | 5 | 5 | — | 5 |
| | Barium sulfate | 18.5 | 16.5 | 16.5 | 20 | 9.5 | 18.5 | 27 | 14.5 |
| | Zinc diacrylate | 27 | 31.5 | 27 | 20.5 | 20.5 | 27 | — | 31.5 |
| | Dicumyl peroxide | 1.2 | 1.2 | 1.2 | 1.2 | 1.2 | 1.2 | — | 1.2 |
| | Himilan 1605 (ionomer) | — | — | — | — | — | — | 50 | — |
| | Himilan 1706 (ionomer) | — | — | — | — | — | — | 50 | — |
| Cover formulation | Himilan 1605 | — | 50 | 50 | 50 | — | — | — | — |
| | Himilan 1706 | — | 50 | 50 | 50 | — | — | — | — |
| | Himilan 1557 | 50 | — | — | — | 50 | 50 | 50 | 50 |
| | Himilan 1601 | 50 | — | — | — | 50 | 50 | 50 | 50 |
| | Barium sulfate | — | — | — | — | 30 | — | — | — |
| Center core | Diameter (mm) | 14.5 | 12.0 | 10.0 | 8.5 | 5.0 | 18.0 | 14.0 | 10.0 |
| | Weight (g) | 1.9 | 1.1 | 0.6 | 0.3 | 0.1 | 3.6 | 1.8 | 0.6 |
| | Specific gravity | 1.18 | 1.22 | 1.22 | 1.22 | 1.14 | 1.18 | 1.22 | 1.14 |
| | Surface Shore D hardness | 64 | 80 | 80 | 80 | 47 | 64 | 80 | 47 |
| | Natural frequency (Hz) | 4230 | 3635 | 3635 | 3635 | 2031 | 4230 | 3635 | 2031 |
| Outer core | Diameter (mm) | 38.5 | 38.5 | 39.0 | 39.0 | 38.5 | 38.5 | 38.5 | 37.7 |
| | Weight (g) | 35.0 | 35.0 | 36.1 | 36.1 | 32.9 | 35.0 | 35.0 | 33.2 |
| | Specific gravity of polybutadiene portion | 1.171 | 1.170 | 1.161 | 1.162 | 1.100 | 1.170 | — | 1.184 |
| | Inside Shore D hardness | 48 | 52 | 48 | 41 | 41 | 48 | 62 | 52 |
| | 120-cm rebound (cm) | 100 | 102 | 104 | 103 | 104.5 | 97 | 85 | 102 |
| | Primary vulcanization conditions | 130° C., 6 min | 130° C., 6 min | 130° C., 6 min | 130° C., 6 min | 130° C., 6 min | 130° C., 6 min | 130° C., 6 min | 130° C., 6 min |
| | Secondary vulcanization conditions | 155° C., 15 min | 155° C., 15 min | 155° C., 15 min | 155° C., 15 min | 155° C., 15 min | 155° C., 15 min | 155° C., 15 min | 155° C., 15 min |

TABLE 1-continued

| Composition (parts by weight) | | E1 | E2 | E3 | E4 | E5 | CE1 | CE2 | CE3 |
|---|---|---|---|---|---|---|---|---|---|
| Golf ball | Weight (g) | 45.3 | 45.3 | 45.3 | 45.3 | 45.3 | 45.3 | 45.3 | 45.3 |
| | Diameter (mm) | 42.7 | 42.7 | 42.7 | 42.7 | 42.7 | 42.7 | 42.7 | 42.7 |
| | Deflection under 100-kg load (mm) | 2.80 | 2.40 | 2.60 | 2.80 | 3.10 | 2.20 | 2.00 | 2.5 |
| | Shore D hardness of cover | 58 | 62 | 62 | 62 | 59 | 62 | 62 | 62 |
| | Cover thickness (mm) | 2.1 | 2.1 | 1.85 | 1.85 | 2.1 | 2.1 | 2.1 | 2.5 |
| Performance at HS45 | Carry (m) | 215.0 | 216.0 | 215.0 | 214.0 | 213.5 | 210.0 | 207.0 | 214.0 |
| | Total distance (m) | 231.0 | 227.5 | 228.0 | 229.0 | 230.0 | 221.0 | 216.0 | 229.5 |
| Feel | | good | good | good | good | good | poor | poor | good |
| Click | | good | good | good | good | good | good | fair | poor |

Japanese Patent Application No. 11–032602 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising a solid core and a cover that encloses the solid core, the solid core having a multilayer construction which includes a center core and an outer core of at least one layer that encloses the center core, wherein the center core is formed primarily of a resin and has a diameter of 3 mm to less than 15 mm, at least one layer of the outer core is formed of a rubber composition based on polybutadiene, and the center core has a Shore D hardness of 40 to 95 at its surface which is higher than the Shore D hardness of an innermost layer of the outer core, and wherein said center core has a specific gravity of 1.0 to 1.5 which is greater than the specific gravity of said at least one layer of the outer core formed of a rubber composition based on polybutadiene, wherein said solid core has a rebound of at least 90 cm when dropped under gravity from a height of 120 cm, and wherein said center core has a natural frequency of at least 1,000 Hz.

2. The solid golf ball of claim 1, wherein said center core has a specific gravity of 1.1 to 1.4 which is greater than the specific gravity of said at least one layer of the outer core formed of a rubber composition based on polybutadiene.

3. The solid golf ball of claim 1, wherein said center core comprises thermoplastic resins and thermoplastic elastomers, such as nylons, polyarylates, ionomer resins, polypropylene resins, thermoplastic polyurehtane elastomers and thermoplastic polyester elastomers.

4. The solid golf ball of claim 3, wherein said center core comprises an inorganic filler as a weight modifier selected from barium sulfate, titanium dioxide and zinc oxide in an amount of not more than 115 parts by weight per 100 parts by weight of resin.

5. The solid golf ball of claim 1, wherein the Shore D hardness of the center core at the surface thereof is 50 to 95.

6. The solid golf ball of claim 1, wherein the Shore D hardness of the center core is 4 to 50 units greater than the hardness of the innermost layer of the outer core.

7. The solid golf ball of claim 1, wherein the outer core has a thickness of 2 to 19.5 mm.

8. The solid golf ball of claim 1, wherein the cover has a thickness of 0.5 to 3.5 mm.

9. The solid golf ball of claim 1, wherein the cover has a Shore D hardness of 40 to 75.

10. The solid golf ball of claim 1, wherein the cover has a specific gravity of 0.95 to 1.25.

11. The solid golf ball of claim 1, wherein the cover is formed of a cover stock selected from ionomer resins, balata rubber, thermoplastic polyurethane, polyamide and polyester elastomers.

12. The solid golf ball of claim 1, wherein the ball has a deflection of 2.4 to 3.8 mm under a static load of 100 kg.

13. A solid golf ball comprising a solid core and a cover that encloses the solid core, the solid core having a multilayer construction which includes a center core and an outer core of at least one layer that encloses the center core, wherein the center core is formed primarily of a resin and has a diameter from 3 mm to less than 15 mm, at least one layer of the outer core is formed of a rubber composition based on polybutadiene, and the center core has a Shore D hardness at its surface which is higher than the Shore D hardness of an innermost layer of the outer core and has a specific gravity of 1.1 to 1.4, wherein said solid core has a rebound of at least 90 cm when dropped under gravity from a height of 120 cm, and wherein said center core has a natural frequency of at least 1,000 Hz.

14. The solid golf ball of claim 13, wherein the specific gravity of the center core is greater than the specific gravity of said at least one layer of the outer core.

15. A solid golf ball comprising a solid core and a cover that encloses the solid core, the solid core having a multilayer construction which includes a center core and an outer core of at least one layer that encloses the center core, wherein the center core is formed primarily of a resin and has a diameter of 3 mm to less than 15 mm, at least one layer of the outer core is formed of a rubber composition based on polybutadiene, and the center core has a Shore D hardness of 40 to 95 at its surface which is higher than the Shore D hardness of an innermost layer of the outer core, wherein said solid core has a rebound of at least 90 cm when dropped under gravity from a height of 120 cm, and wherein said center core has a natural frequency of at least 1,000 Hz.

16. A solid golf ball comprising a solid core and a cover that encloses the solid core, the solid core having a multi-layer construction which includes a center core and an outer core of at least one layer that encloses the center core, wherein the center core is formed primarily of a resin and has a diameter of 3 mm to less than 15 mm, at least one layer of the outer core is formed of a rubber composition based on polybutadiene, and the center core has a Shore D hardness of 40 to 95 at its surface which is higher than the Shore D hardness of an innermost layer of the outer core, wherein the cover has a Shore D hardness of 40 to 75, wherein said solid core has a rebound of at least 90 cm when dropped under gravity from a height of 120 cm, and wherein said center core has a natural frequency of at least 1,000 Hz.

17. A solid golf ball comprising a solid core and a cover that encloses the solid core, the solid core having a multi-layer construction which includes a center core and an outer core of at least one layer that encloses the center core, wherein the center core is formed primarily of a resin and has a diameter of 3 mm to less than 15 mm, at least one layer of the outer core is formed of a rubber composition based on polybutadiene; and the center core has a Shore D hardness of 40 to 95 at its surface which is higher than the Shore D hardness of an innermost layer of the outer core, wherein the cover has a specific gravity of 0.95 to 1.25, wherein said solid core has a rebound of at least 90 cm when dropped under gravity from a height of 120 cm, and wherein said center core has a natural frequency of at least 1,000 Hz.

* * * * *